US009683178B2

(12) United States Patent
McFarlane

(10) Patent No.: US 9,683,178 B2
(45) Date of Patent: Jun. 20, 2017

(54) PROCESS FOR REDUCING ACIDITY OF HYDROCARBON FEEDS

(75) Inventor: Richard A. McFarlane, Alberta (CA)

(73) Assignee: Suncor Energy Inc., Calgary (CA)

( * ) Notice: Subject to any disclaimer, the term of this patent is extended or adjusted under 35 U.S.C. 154(b) by 164 days.

(21) Appl. No.: 13/392,829

(22) PCT Filed: Aug. 27, 2010

(86) PCT No.: PCT/CA2010/001331

§ 371 (c)(1),
(2), (4) Date: Feb. 27, 2012

(87) PCT Pub. No.: WO2011/022832

PCT Pub. Date: Mar. 3, 2011

(65) Prior Publication Data

US 2012/0152807 A1 Jun. 21, 2012

(30) Foreign Application Priority Data

Aug. 28, 2009 (CA) ..... 2677004

(51) Int. Cl.
*C10G 21/16* (2006.01)
*C10G 21/28* (2006.01)
*C10G 21/06* (2006.01)

(52) U.S. Cl.
CPC ..... *C10G 21/16* (2013.01); *C10G 21/28* (2013.01); *C10G 2300/202* (2013.01); *C10G 2300/203* (2013.01); *C10G 2300/80* (2013.01)

(58) Field of Classification Search
CPC .. C10G 21/16; C10G 21/28; C10G 2300/202; C10G 2300/203; C10G 2300/80; C10G 21/06

(Continued)

(56) References Cited

U.S. PATENT DOCUMENTS 1,472,384 A 10/1923 Brown
2,269,134 A 1/1942 Tarnoski
(Continued)

FOREIGN PATENT DOCUMENTS

CA 2657844 C 2/2008
CN 1334857 A 2/2002
WO WO2009070255 6/2009

OTHER PUBLICATIONS

Baker Hughes, Planning Ahead for Effective Canadian Crude Processing, 2010, p. 1-7.*

(Continued)

*Primary Examiner* — Renee Robinson
*Assistant Examiner* — Derek Mueller
(74) *Attorney, Agent, or Firm* — McCarthy Tétrault LLP

(57) ABSTRACT

A method for processing an acidic hydrocarbon feed comprising a hydrocarbon material and an acidic constituent soluble in the feed is provided. The method may comprise contacting the feed under a first condition with an active agent having an initial solubility in the feed and the acidic constituent and providing a second condition wherein the active agent has a secondary solubility in the feed lesser than the initial solubility to form a separable enriched active agent phase. The acidic constituent solubility in the active agent may be greater than its solubility in the hydrocarbon material under both the first and second conditions such that the acidic constituent dissolves in the active agent. The acidic constituent solubility in the active agent under the second condition may be greater than its solubility in the active agent under the first condition. The method may further comprise separating the enriched active agent phase from the hydrocarbon material depleted in the acidic constituent under the second condition.

36 Claims, 6 Drawing Sheets

(58) Field of Classification Search
USPC ..... 208/189, 203, 204, 263, 283, 290, 291, 208/370
See application file for complete search history.

(56) References Cited

U.S. PATENT DOCUMENTS

| | | | | |
|---|---|---|---|---|
| 2,391,729 | A | 12/1945 | McCorquodale | |
| 2,610,209 | A | 9/1952 | Honeycutt | |
| 2,769,768 | A | 11/1956 | Fierce | |
| 2,808,431 | A | 10/1957 | Fierce | |
| 2,911,360 | A * | 11/1959 | Myers | 208/263 |
| 3,409,543 | A * | 11/1968 | Urban et al. | 208/234 |
| 3,644,214 | A | 2/1972 | Akell | |
| 4,001,109 | A | 1/1977 | Li | |
| 4,098,692 | A | 7/1978 | Baker | |
| 4,216,079 | A | 8/1980 | Newcombe | |
| 4,216,114 | A | 8/1980 | Baker | |
| 4,406,774 | A | 9/1983 | Cummings | |
| 4,551,239 | A | 11/1985 | Merchant | |
| 4,634,519 | A | 1/1987 | Danzik | |
| 4,684,457 | A | 8/1987 | McKechnie | |
| 4,737,265 | A | 4/1988 | Merchant | |
| 4,738,795 | A | 4/1988 | Farnand | |
| 4,895,641 | A | 1/1990 | Briceno | |
| 5,039,450 | A | 8/1991 | Kupfer | |
| 5,746,908 | A | 5/1998 | Mitchell | |
| 5,855,768 | A | 1/1999 | Stanciulescu | |
| 6,096,196 | A | 8/2000 | Varadaraj et al. | |
| 6,190,541 | B1 | 2/2001 | Siskin | |
| 6,464,859 | B1 * | 10/2002 | Duncum et al. | 208/263 |
| 6,627,069 | B2 | 9/2003 | Greaney | |
| 6,989,103 | B2 | 1/2006 | Mohsen | |
| 7,867,382 | B2 | 1/2011 | Droughton | |
| 2007/0175799 | A1 | 8/2007 | Tomlinson | |
| 2009/0134068 | A1 | 5/2009 | Falkiner | |

OTHER PUBLICATIONS

Office Action dated Dec. 27, 2012 for Application No. 2,677,004, issued by the Canadian Patent Office.
Office Action dated May 9, 2013 for Application No. 2,677,004, issued by the Canadian Patent Office.
Office Action dated Dec. 15, 2012, for Application No. 2010286299, issued by the Australian Patent Office.
Office Action dated Dec. 3, 2013, for Application No. 201080048138.9, issued by the State Intellectual Property Office of the People's Republic of China (together with an English language translation).
International Search Report and Written Opinion issued on Nov. 24, 2010 for International Application No. PCT/CA2010/001331.
Lemley, et al., "Liquid Ammonia Solutions X A Raman Study of Interactions in the Liquid State", *The Journal of Physical Chemistry*, vol. 77, No. 18, 1973.
Bratsch, et al., "On the Existence of Na- in Liquid Ammonia", The Journal of Physical Chemistry, vol. 88, No. 6, 1984.
Nour, et al., "Chemical Demusification of Water-in-Crude Oil Emulsions", Journal of Applied Sciences, 7(2): 196-201, 2001.
Ovchinnikov, Max et al., "Oil sands-derived feed processing", (2013) PTQ Q3 1-12, www.digitalrefining.com/article/1000850.

* cited by examiner

PROCESS FOR REDUCING ACIDITY OF HYDROCARBON FEEDS

CROSS REFERENCE TO RELATED APPLICATIONS

This application is the U.S. National Phase of International Application No. PCT/CA2010/001331, filed Aug. 27, 2010, designating the U.S. and published as WO 2011/022832 on Mar. 3, 2011 which claims the benefit of Canadian Patent Application No. 2,677,004 filed Aug. 28, 2009.

FIELD OF THE INVENTION

The invention relates generally to processing of hydrocarbon feeds derived from in situ and ex situ tar sand and heavy oil operations, off shore oil production operations, conventional oil, secondary and tertiary recovery, and natural gas operations. More particularly, the invention relates to processing acidic hydrocarbon feeds to effect a reduction in the content of acidic constituents and thereby obtain a hydrocarbon material depleted in the acidic constituents to a level suitable for downstream processing operations.

BACKGROUND OF THE INVENTION

Hydrocarbon feeds derived from various oil and gas processing operations such as, for example, various bitumen-derived hydrocarbon fractions often contain chemical species harmful to the efficient operation of downstream processes, and affect the quality of the final hydrocarbon product. Such chemical species include acidic species commonly found in hydrocarbon feeds such as, for example, various organic acids including naphthenic acids.

Acidic hydrocarbon feeds may arise, for example, when hydrocarbon feeds undergo biodegradation in situ as a result of which various acidic constituents may form, or during processing when the hydrocarbon feeds are combined with various chemical agents and processed at elevated temperatures. If the acidic constituents are allowed to remain in the hydrocarbon feed throughout the various stages of processing, they will often cause corrosion of equipment used to extract, process and transport the feed. Some species such as, for example, mercaptants and hydrogen sulfide, may cause unpleasant odour. Hydrogen sulfide is also highly toxic.

A variety of approaches have been proposed for minimizing the effects of the acidic constituents. For example, one approach involves blending of a hydrocarbon feed comprising a high naphthenic acid content with a hydrocarbon feed comprising a low naphthenic acid content. Another approach involves the use of corrosion inhibitors such as, for example, polysulfides for treating the surfaces of equipment that come in contact with the acidic hydrocarbon feed. Yet another approach involves neutralizing the acidic constituents in the hydrocarbon feed using, for example, an aqueous solution of sodium or potassium hydroxide and subsequently removing the neutralized species from the feed. Thermal and catalytic treatments have also been used to thermally crack or catalytically convert the acidic constituents into non-acidic species.

The above approaches present several difficulties especially when applied to bitumen or bitumen-derived acidic feeds. For example, in the case of neutralization of the acidic hydrocarbon feed with basic aqueous solutions, some of the undesirable effects include formation of emulsions with the hydrocarbon feed, increases in the organic salt content including those of calcium, magnesium and sodium, which further exacerbate corrosion and other issues in downstream processing. Thermal treatment approaches require high temperature and pressure, and catalytic thermal treatments often suffer from catalyst deactivation. Moreover, thermal treatment to crack and eliminate constituents may produce undesirable cracked hydrocarbon products, and depending on the complexity of the feed, thermal cracking may not be effective at reducing the content of the acidic constituents. Addition of corrosion inhibitors to the acidic hydrocarbon feed may result in other processing complications in downstream processing equipment such as catalyst poisoning, inhibition, or fouling. Approaches involving blending of various high and low TAN hydrocarbon feeds may result in high inventory costs and increased logistical and feed supply costs such as for example sourcing and obtaining delivery of lower TAN hydrocarbon feeds for blending. The use of corrosion-resistant metals in the construction of refining units results in specialized refining facilities with significant increased capital investment to provide the corrosion-resistant units. Moreover, this approach is expensive to retrofit onto existing refining facilities due to changes in component parts, increased component costs, changes in process flows and changeover production losses.

Therefore, processing acidic hydrocarbon feeds to effect a reduction in the content of the acidic constituents and to form a hydrocarbon material suitable for downstream processing operations such as, for example, upgrading remains challenging.

SUMMARY OF THE INVENTION

In accordance with one aspect of the invention, there is provided a method of processing an acidic hydrocarbon feed having an acidic constituent and a hydrocarbon material. The method comprises contacting the acidic hydrocarbon feed with an active agent under a first operating condition, wherein under the first operating condition the active agent has an initial active agent solubility in the acidic hydrocarbon feed and the acidic constituent has an acidic constituent solubility in the acidic hydrocarbon feed. The method further comprises modulating operating conditions to provide a second operating condition, wherein under the second operating condition the active agent has a secondary active agent solubility in the hydrocarbon feed that is less than the initial active agent solubility so as to form a separable enriched active agent phase, wherein the acidic constituent solubility in the active agent is substantially greater than the acidic constituent solubility in the hydrocarbon material under both the first and second operating conditions such that the acidic constituent dissolves in the active agent, and wherein the acidic constituent solubility in the active agent under the second operating condition is greater than the acidic constituent solubility in the active agent under the first operating condition. The separable enriched active agent phase is then allowed to separate from the hydrocarbon material depleted in the acidic constituent under the second operating condition.

In various aspects, the initial solubility of the active agent in the hydrocarbon feed may range from about 0.001 wt. % to about 10 wt. %, and the acidic constituent solubility in the hydrocarbon feed may range from about 0.001 wt. % to about 5 wt. %. In various embodiments, the acidic constituent solubility in the active agent may range from about 0.01 wt. % to about 50 wt. %.

In various aspects, the acidic hydrocarbon feed may have a total acid number value ranging from about 0.01 to about 10 mg-KOH/g-oil or greater, and the acidic constituent in the acidic hydrocarbon feed may have a concentration expressed by a total acid number ranging from about 0.5 to about 100 mg-KOH/g-oil. In various aspects, the acidic constituent comprises a naphthenic acid, hydrogen sulphide, a hydrochloric acid, a phenol, or a combination thereof. The acidic constituent may further comprise a mercaptan.

In various aspects, the operating conditions such as temperature, pressure, time or a combination thereof may be modulated to provide the second operating condition. In various aspects, modulating operating conditions comprises modulating a composition of the active agent such that the composition of the active agent under the second operating condition is different from the composition of the active agent under the first operating condition.

In various aspects, the active agent comprises a protic active agent such as an alcohol. For example, the alcohol may be selected from alcohols having 1 to 4 carbons (e.g., methanol). In various aspects, the active agent may also be a mixture which comprises a modifier such as, for example, water in a volume ratio of the active agent to the modifier wherein the modifier has an initial solubility in the hydrocarbon feed under the first operating condition that is different from the secondary active agent solubility. Water is an example The active agent mixture may have a concentration of the active agent ranging from about 99.9 wt. % to about 50 wt. %. In various aspects, the active agent may further comprise an additive such as, for example, sodium hydroxide, potassium hydroxide, sodium carbonate, bicarbonate or a combination thereof.

In various aspects, the hydrocarbon material depleted in the acidic constituent comprises an acidic constituent content equivalent to total acid number ranging from about 0 to about 1.0 mg-KOH/g-hydrocarbon, and in some embodiments, the hydrocarbon material may further be depleted in chlorides.

In various aspects, the separable enriched active agent phase may be a distinct acidic active agent phase, a distinct basic active agent phase, or a distinct neutral active agent phase. In various aspects, the separable enriched active agent phase under the second operating condition comprises an acidic constituent content or a neutralized acidic constituent, the acidic constituent or the neutralized acidic constituent having a content equivalent to total acid number ranging from about 1.0 to about 100.0 mg-KOH/g-active agent phase. In various aspects, the separable enriched active agent phase under the second operating condition further comprises a chloride content.

In accordance with another aspect, the method further comprises recovering the separable enriched active agent phase, separating the separable enriched active agent phase from the acidic constituent or from the neutralized acidic constituent to obtain a recovered active agent, and recycling the recovered active agent to the contacting step of claim 1. In various aspects, recycling comprises modulating a composition of the recovered active agent to achieve the initial active agent solubility in the hydrocarbon material. In various aspects, modulating comprises adjusting a dielectric property of the recovered active agent.

In various aspects, a composition of the active agent may be modulated to achieve the initial active agent solubility in the hydrocarbon material. In various aspects, modulating comprises adjusting a dielectric property of the active agent.

In accordance with another aspect of the invention, there is provided an apparatus for processing an acidic hydrocarbon feed having an acidic constituent and a hydrocarbon material. The apparatus comprises a source of the acidic hydrocarbon feed, a source of an active agent, and contacting means for contacting the acidic hydrocarbon feed with the active agent. The apparatus further comprises modulating means for modulating operating conditions to provide a first operating condition and a second operating condition, wherein under the first operating condition the active agent has an initial active agent solubility in the hydrocarbon feed and the acidic constituent has an acidic constituent solubility in the hydrocarbon feed, wherein under the second operating condition the active agent has a secondary active agent solubility in the hydrocarbon feed that is less than the initial active agent solubility so as to form a separable enriched active agent phase, and wherein the acidic constituent solubility in the active agent is substantially greater than the acidic constituent solubility in the hydrocarbon feed under both the first and second operating conditions such that the acidic constituent dissolves in the active agent. The apparatus further comprises separating means for separating the separable enriched active agent from the hydrocarbon material depleted in the acidic constituent under the second operating condition.

In various aspects, the apparatus further comprises recovering means for recovering the separable enriched active agent phase to form a recovered active agent phase, and recycling means for recycling the recovered active agent phase into the source of the active agent.

BRIEF DESCRIPTION OF THE DRAWINGS

In accompanying drawings which illustrate embodiments of the invention.

DETAILED DESCRIPTION

Figure 1:
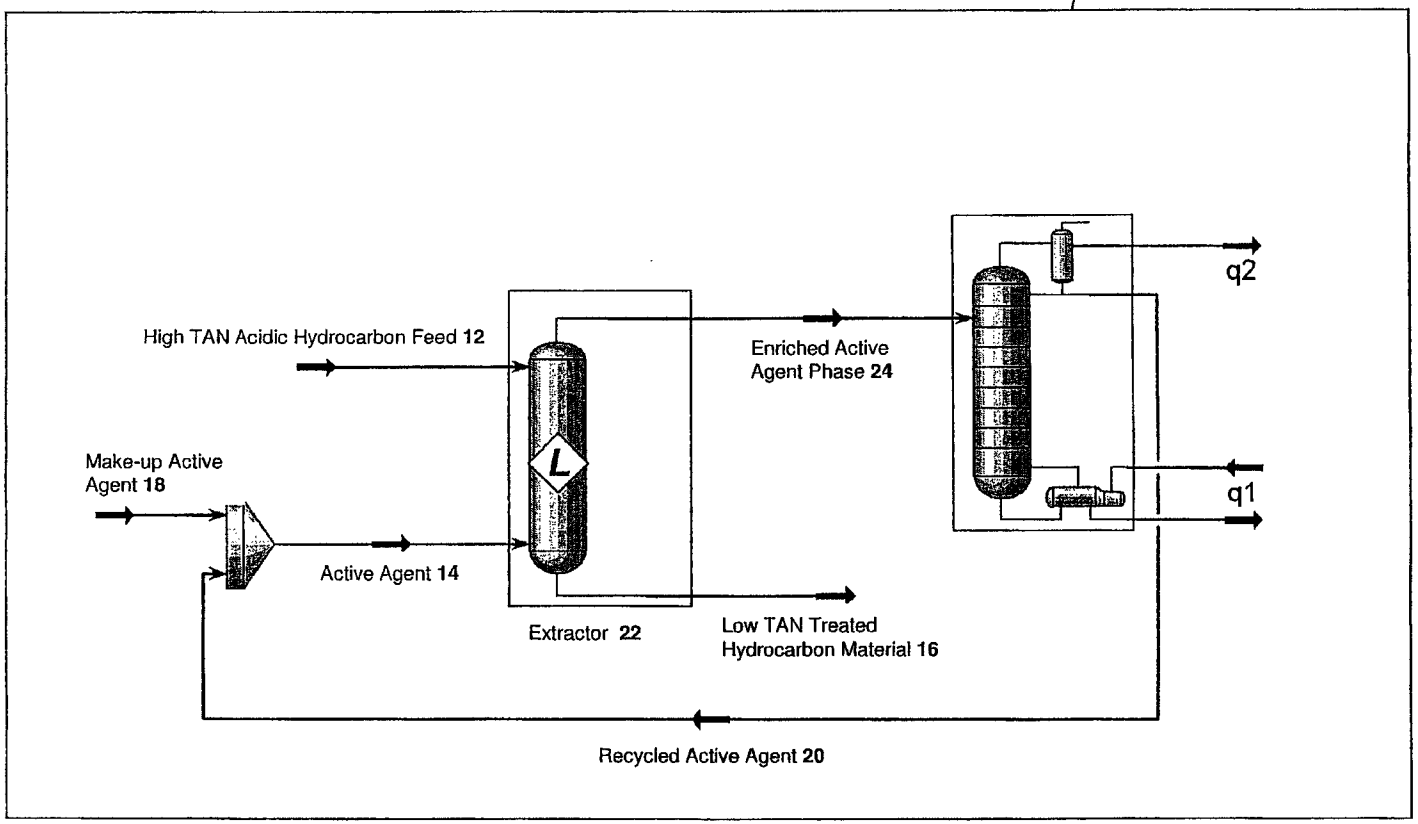
FIG. 1 illustrates a schematic diagram of system 10 according to a first embodiment of the invention.

Reference will now be made in detail to implementations and embodiments of various aspects and variations to the invention, examples of which are illustrated in the accompanying drawings.

In various aspects, the present invention involves contacting an acidic hydrocarbon feed with an active agent, the acidic hydrocarbon feed comprising a hydrocarbon material and an acidic constituent and having an initial total acid number ("TAN"). The active agent having an initial active agent solubility in the hydrocarbon material and a secondary active agent solubility in the hydrocarbon material that is less than the initial active agent solubility at selected operating conditions. The acidic constituent having an acidic constituent solubility in the hydrocarbon material and an acidic constituent solubility in the active agent, the acidic constituent solubility in the active agent being substantially greater than the acidic constituent solubility in the hydrocarbon material such that the acidic constituent dissolves in the active agent under selected operating conditions. In various embodiments, the step of contacting the acidic hydrocarbon feed with the active agent is performed under a selected contact time, temperature, pressure or a combination thereof to effect a transfer of the acidic constituent from the acidic hydrocarbon feed into the active agent and to form a separable enriched active agent phase enriched in the acidic constituents which may exist in the separable enriched active agent phase as acidic, neutral or other species, and a treated hydrocarbon material depleted in the acidic constituents (i.e., having a lower TAN than the initial TAN of the acidic hydrocarbon feed). In various embodiments, the present invention further involves separating the separable enriched active agent phase from the treated hydrocarbon material.

In various embodiments, the term "acidic hydrocarbon feed" relates to any natural or synthetic liquid, semi-liquid or solid hydrocarbon material, which may comprise aromatic species, and which is derived from oil sands processing in situ and ex situ including hydrocarbon material having an API value of less than about 10°, heavy (e.g., about 10 to 22.3° API), medium (e.g., about 22.3 to 31.1° API) and light (e.g., >about 31.1° API) oil production, off shore oil production, natural gas operations, conventional oil, secondary and tertiary recovery, or any other industry (e.g., biofuel industry) wherein the acidic hydrocarbon feed comprises at least one acidic constituent. In various embodiments, the acidic hydrocarbon feed may have a content of about 50% or greater of atmospheric residuum (boiling point greater than about 343° C.) in which the fraction of carbon that is aromatic is greater than or equal to about 25%. In various embodiments, an initial content of various chemical species in the acidic hydrocarbon feed such as, for example, the content of the acidic constituent or of the aromatic species in the feed may be changed or modulated from their initial content in the feed by, for example, diluting the hydrocarbon feed with various diluents such as naphtha or by blending the feed with other hydrocarbon feeds which may have a different content of the particular chemical species.

A heavy hydrocarbon feed may have at least about 12.5% of aromatic carbon. Various heavy oils from around the world show that the residua contain about 22.4 to about 40.1% of aromatic carbon. Hydrocarbon feeds with less than about 24% aromatic carbon are generally considered as being paraffinic (S. Beret and J. G. Reynolds, Effect of perhydrogenation on hydroconversion of Maya Residuum, Part II. Hydrogen incorporation, *Fuel Science & Technology International* 8(3), 1990, 191-219).

Generally, the hydrocarbon feed having API gravity of less than 10° to about 22.3° (e.g., bitumen) will comprise aromatic species and a substantial content of sulphur and nitrogen. In various embodiments, the aromatic species in the hydrocarbon feed will vary in content and composition depending on the origin of the feed and processing. The aromatic content of the acidic hydrocarbon feed may be determined based on the origin and characteristics of the acidic hydrocarbon feed, and using various analytical techniques known in the art. In various embodiments, the acidic hydrocarbon feed may have an initial viscosity ranging from less than about 1 cP to about 1,000,000 cP or greater. Suitable viscosities of the acidic hydrocarbon feed at various processing conditions may be determined, for example, by the requirements of the mass transfer equipment to achieve good interfacial contact between the hydrocarbon feed and the active agent.

In various embodiments, the acidic hydrocarbon feed comprising for example bitumen, bitumen-derived fractions or combinations thereof presents unique processing challenges as compared to various other acidic hydrocarbon feeds, such as for example conventional light and waxy crude oil-derived hydrocarbon feeds, which generally comprise a substantially lower content and different composition of aromatic species. For example, Athabasca bitumen may have an API gravity of 7°, about 4.5 wt. % sulphur, TAN from about 2 to about 8 and contains and about 88 wt. % of atmospheric residuum (boiling point greater than 343° C.) with about 32% of aromatic carbon. Duri heavy oil may have an API gravity of 21°, about 0.2 wt. % sulphur, TAN of about 1.3 and contains about 77 wt. % of atmospheric residuum with about 22% of aromatic carbon. In various embodiments, virgin bitumen distillates are low in hydrogen content and may contain relatively high concentrations of various ringed molecular structures, including aromatic species, aside from various acidic constituents. For example, bitumen derived from Canadian Athabasca oil sand may contain about 95% ringed molecular structures as compared to about 10% to about 50% ringed molecular structure content found in conventional crude oil hydrocarbon feeds. Additional distinguishing characteristics for hydrocarbon feeds such as bitumen include viscosity and density of the feed (Table 1).

TABLE 1

| Oil Type | °API Gravity | Density ($kg/m^3$) | Viscosity (cP)* |
|---|---|---|---|
| Light | >31.1 | 870 | <10 |
| Medium | 22.3-31.1 | 920-870 | 10-100 |
| Heavy | 10-22.3 | 920-1,000 | 100-10,000 |
| Extra-heavy and bitumen | <10 | >1,000 | >10,000 |

Notes:
*Dead oil viscosity at reservoir temperature.

Hydrocarbon feeds having API gravity ranging from less than 10 to about 22 present challenges in downstream processing as compared to conventional crude oil-derived feeds. Bitumen-derived distillates or fractions typically have a high molecular weight, high density, and low fluidity properties. These unique properties of bitumen-derived virgin fractions, particularly under lower hydroprocessing severity, present various processing challenges and hence are more difficult to upgrade into synthetic crude oil. Moreover, the organic characteristics of bitumen hydrocarbons vary from one location to another. In the processing of bitumen, bitumen fractions that are typically produced comprise a high content of organic acids relative to other hydrocarbon fractions, and also contain high concentrations of sulfur, nitrogen and other undesirable species. The organic acid species present in such feed may also have a different chemical composition and molecular size than those occurring in acidic hydrocarbon feeds having a low aromatic content. These unique properties also present unique challenges for reducing the content of the acidic constituents in such hydrocarbon feeds because the acidic constituents may be trapped and associated with other species within the heterogeneous bitumen matrix, and thus more difficult to remove. In various embodiments, the hydrocarbon feed comprising bitumen may have a concentration of the acidic constituents as expressed by a total acid number (TAN) ranging from about 0.5 to about 100 mg-KOH/g-oil.

In various embodiments, the acidic hydrocarbon feed comprising bitumen may have a concentration of the acidic constituent as expressed by a total acid number (TAN) ranging from about 0.5 to about 2 mg-KOH/g-oil, or about 2 to about 5 mg-KOH/g-oil, or about 5 to about 10 mg-KOH/g-oil, or about 10 to about 20 mg-KOH/g-oil, or about 20 to about 40 mg-KOH/g-oil, or about 40 to about 60 mg-KOH/g-oil, or about 60 to about 80 mg-KOH/g-oil, or about 80 to about 100 mg-KOH/g-oil or greater. The weight percent of the acidic constituent in the hydrocarbon is directly related to total acid number but depends on the molecular weight of the acidic constituent which may range from 36.46 g/mole for small inorganic acid such as hydrochloric acid to 284.48 g/mole for stearic acid to greater than 800 g/mole for TAN acids in Athabasca bitumen (D. F. Smith, T. M. Schaub, S. Kim, R. P. Rodgers, P. Rahimi, A. Teclemariam, and A. G. Marshall, Characterization of Acidic Species in Athabasca Bitumen and Bitumen Heavy Vacuum Gas Oil by Negative-Ion ESI FT-ICR MS with and without Acid-Ion Exchange Resin Prefractionation. *Energy & Fuels* 2008, 22, 2372-2378). The weight percent of the acidic constituent in the acidic hydrocarbon feed can therefore range from about 0.03 to about 0.5 wt. % or about 0.5 to about 1 wt. %, or about 1 to about 5 wt. % or about 5 to about 10 wt. %, or about 10 to about 15 wt. % or about 15 to about 20 wt. % or greater.

In various embodiments, the term "acidic constituent" relates to organic and inorganic species in the acidic hydrocarbon feed which cause the acidic hydrocarbon feed to have acidic properties. Examples of acidic constituents that may be present in the acidic hydrocarbon feed include naphthenic acids, phenols, and hydrochloric acid. Other species such as $H_2S$ and mercaptans may also be included in TAN (a "total acid number" or a "neutralization number") with phenols and naphthenic acids. In various embodiments, for the purposes of TAN analysis, the $H_2S$ and mercaptant species may or may not be removed. In selected embodiments, $H_2S$ and mercaptants are removed prior to determining TAN. Indicators for determining whether the hydrocarbon feed is acidic include, for example, TAN ranging from about 0.5 to about 10 mg-KOH/g-oil, and weight percent naphthenic acid ranging from about 0.1 to 2 wt. %. Various analytical methods known in the art may be used to determine the acidity of the hydrocarbon feed, including gas and liquid chromatography with sulphur-specific detectors for detecting $H_2S$ and mercaptan species. In various embodiments, TAN refers to the amount of potassium hydroxide (KOH) in milligrams that is needed to neutralize all acid components (e.g., light organic acids, naphthenic acids, phenols, inorganic acids, any acids present that have been added during processing or production, and $H_2S$ and mercaptans if these species were not removed prior to neutralization with KOH and analysis) in one gram of oil. The TAN value of the acidic hydrocarbon feed may be obtained by various methods known in the art, such as for example, potentiometric or colorimetric titrations or other non-titrimetric methods such as infrared analysis. UOP 565 and UOP 567 are examples of potentiometric and colorimetric analytical methods for determination of TAN that require prior removal of reactive sulfur compounds as described, for example, by Tebbal (S. Tebbal, Critical review of naphthenic acid corrosion, *NACE Conference, Corrosion* 99, Paper No. 380). A content of naphthenic acids in the acidic hydrocarbon feed may be obtained, for example, by spectroscopic analytical methods using commercial naphthenic acids as a standard. In various embodiments, the acidic hydrocarbon feed may have a TAN value of about 0.01 to about 0.1, about 0.1 to about 3.5, about 3.5 to about 10 or higher. Acidic hydrocarbon materials with a TAN greater than about 1.0 are often referred to as high TAN or high acid hydrocarbon materials.

The acidic hydrocarbon feed may comprise a variety of acidic constituents having compositional heterogeneity, which may include for example fatty acids (e.g., alkanoic and alkenoic acids with more than four carbons) as well as saturated and unsaturated acids containing ring structures such as aromatic and naphthenic acids. Naphthenic acids are mixtures of cycloaliphatic carboxylic acids and may be present in the acidic hydrocarbon feed in varying amounts. The general chemical formula of naphthenic acids is $R(CH_2)_n$ COOH (Formula 1), where $R(CH_2)_n$ is any cycloaliphatic structure. Naphthenic acids are composed predominantly of alkyl-substituted cycloaliphatic carboxylic acids, with smaller amounts of non-cycloaliphatic acids. In the case of aromatic hydrocarbon feeds, naphthenic acids structure can also include single aromatic rings or two or more fused aromatic rings. Aromatic, olefinic, hydroxyl, dibasic and tetrabasic acids may also be present as minor components. The naphthenic acid structures, particularly in heavy oils and bitumen may contain other heteroatoms such as sulphur and nitrogen.

Naphthenic acids occurring in acidic hydrocarbon feeds such as, for example, bitumen and bitumen-derived feeds are a complicated heterogeneous mixture of compounds. The nature and amount of the naphthenic acids and other acidic constituents in the acidic hydrocarbon feed will vary depending on the source and processing of the acidic hydrocarbon feed. Acidic constituents such as naphthenic acids with similar molecular weight and TAN due to their heterogeneity may have different molecular structures and varying ability to stabilize emulsions in the acidic hydrocarbon feed comprising such emulsions (e.g., water-in-oil emulsions), and thus increase the complexity of processing such acidic hydrocarbon feed to reduce the content of the acidic substituents. In various embodiments, the naphthenic acids may be present in the acidic hydrocarbon feed either alone or in combination with other acidic species, for example, such as phenols, hydrochloric acid, or with hydrogen sulphide and mercaptans. Therefore, in various embodiments, operating conditions are tailored for reducing the content of the particular acidic constituents in the particular acidic hydrocarbon feed to be processed using the system and process of the present invention.

Naphthenic acids are formed by either aerobic or anaerobic biodegradation processes where the light hydrocarbons are converted before intermediate size hydrocarbons. Thus, heavy hydrocarbon feeds such as bitumen and bitumen-derived feeds usually have a higher content of the acidic constituents than lighter or conventional hydrocarbon feeds such as paraffinic crudes. In various embodiments, the content and chemical makeup of the acidic constituents may also vary depending on the maturity and biodegradation levels of the oil sand source. Table 2 shows API gravity values and TAN for various California heavy crudes.

TABLE 2

| Acidic Hydrocarbon Feed | API Gravity | TAN |
|---|---|---|
| San Ardo | 12.2 | 4.0 |
| Kern River | 13.3 | 2.7 |
| Wilmington | 17.1 | 1.3 |

Acidic constituents such as naphthenic acids may be distributed within the acidic hydrocarbon feed comprising an aqueous component at the water-hydrocarbon interface as monolayers, liquid crystalline films, and other colloidal structures, or within the hydrocarbon material in wet and dehydrated hydrocarbon feeds. In various embodiments, the process of the present invention may be tailored to reducing the content of the acidic constituent in the acidic hydrocarbon feed depending on the predominant form and chemical properties of the acidic constituent.

The terms "active agent" and "active agent composition" are used interchangeably and relate to a chemical compound or a composition which, when contacted with the acidic hydrocarbon feed, is able to effect at selected processing parameters a reduction in the content of the acidic constituent in the acidic hydrocarbon feed:

i. the active agent has an initial active agent solubility in the acidic hydrocarbon feed. In various embodiments, the active agent solubility in the acidic hydrocarbon feed may range from about 0.001 wt. % to about 0.01 wt. %, about 0.01 wt. % to about 1 wt. %, about 1 wt. % to about 5 wt. %, about 5 wt. % to about 10 wt. % or greater. In selected embodiments, the preferred active agent solubility in the acidic hydrocarbon feed ranges from about 0.001 wt. % to about 0.01 wt. %;

ii. the acidic constituent has an acidic constituent solubility in the acidic hydrocarbon feed. In various embodiments, the acidic constituent solubility in the acidic hydrocarbon feed may range from about 0.001 wt. % to about 5 wt. % or greater; and iii. the acidic constituent has an acidic constituent solubility in the active agent, the acidic constituent solubility in the active agent being greater than the acidic constituent solubility in the acidic hydrocarbon feed such that the active agent may solubilize the acidic constituent and form a distinct separable enriched active agent phase at selected conditions to effect a reduction of the content of the acidic constituent in the acidic hydrocarbon feed. In various embodiments, the acidic constituent solubility in the active agent may range from about 0.01 wt. % to about 1 wt. %, or about 1 wt. % to about 5 wt. %, or about 5 wt. % to about 10 wt. %, or about 10 wt. % to 20 wt. %, or about 20 wt. % to about 30 wt. %, or about 30 wt. % to about 40 wt. % or greater.

TAN acids have polar acid head groups and less polar hydrocarbon tail groups. In various embodiments, the solubility of the TAN acids depends on the polarity of the active agent and the size and nature of the less polar hydrocarbon tail groups in the TAN acids. Acids with small hydrocarbon tails (e.g., formic acid, acetic acids) will generally be much more soluble in polar active agents having a polarity closer to the polarity of water as compared to the non-polar hydrocarbon feed. In contrast, acids with much larger hydrocarbon tail (e.g., palmitic, stearic, oleic) will be more soluble in relatively less polar active agents. The TAN acids may also have one or more polar acid functional groups and a wide range of less polar hydrocarbon tail groups including those containing polar heteroatoms such as oxygen and nitrogen which could enhance their solubility in active agents of intermediate polarity between the polarity of the hydrocarbon feed and the polarity of water. In various embodiments, examples of suitable active agents for removing TAN acid are active agents having intermediate polarity between the polarity of the acidic hydrocarbon feed and the polarity of water.

The dielectric constant is a useful measure of the polarity of the active agent and the hydrocarbon feed. The dielectric constant of water at 25° C. is 78.85. Based on published data of R. S. Chow et al., *The Canadian Journal of Chemical Engineering*, vol. 82, August 2004, the dielectric constant of Athabasca bitumen is about 3.7 at 30° C. Dilution of the bitumen with naphtha will typically lower the dielectric constant as shown in the same reference. Table 3 summarizes the dielectric constants of various organic acids which give a representative range of dielectric constants for TAN acids. Acids with dielectric constants closer to that of the hydrocarbon feed are likely to be more soluble in the hydrocarbon feed compared to active agents with high dielectric constants closer to the dielectric constant of water.

TABLE 3

| Acid | Dielectric Constant |
|---|---|
| Formic[a] | 58.0 @ 16° C. |
| Acetic[a] | 6.2 @ 20° C. |
| Propionic[a] | 3.1 @ 14° C. |
| Butyric[a] | 3.0 @ 20° C. |
| Palmitic[a] | 2.3 @ 71° C. |
| Stearic[a] | 2.3 @ 71° C. |
| Phthalic[b] | 5.1-6.3 |
| 3,4-demethyl-benzoic acid[b] | 7.8 @ 21° C. |

Notes:
[a]Dean's Handbook of Organic Chemistry (2nd Edition). McGraw-Hill, 2004;
[b]Knovel Critical Tables (2nd Edition). Knovel, 2008.

TAN acids with dielectric constants closer to the dielectric constant of non-polar hydrocarbon may be more soluble in protic active agents with high dielectric constants due to ability to hydrogen-bond with the protic active agent and to dissociate. TAN acids which are not very soluble in polar active agents may preferentially reside at the interface between the polar active agent and the non-polar hydrocarbon material of the hydrocarbon feed. In this case, the less polar hydrocarbon end (hydrophobic tail) will reside in the less polar hydrocarbon feed and the polar end (hydrophilic head) will reside in the more polar protic active agent where it can hydrogen-bond and dissociate.

The extent to which the acid dissociates is given by the pKa of the acid in a particular solvent (Formulas 2 and 3):

$$RCOOH \rightleftharpoons RCOO^- + H^+ \quad \text{(Formula 2)}$$

$$K_a = [RCOO^-][H^+]/[RCOOH]$$

$$pK_a = -\log_{10}(K_a) \quad \text{(Formula 3)}$$

The lower the $pK_a$, the greater the degree of dissociation of the TAN acid. The $pK_a$ of the acid in a particular active agent is related to the dielectric constant of the active agent and whether it is a protic or aprotic active agent. Table 4 summarizes the $pK_a$ values for 3,4-dimethylbenzoic acid (3,4-DMBA) in various potential active agents and other solvents for comparison with different dielectric constants. It can be seen that for both protic and aprotic active agents, $pK_a$ decreases and acid dissociation increases with increasing dielectric constant of the active agent.

TABLE 4

| Potential Active Agent** | Type | Dielectric Constant | pKa, 3,4-DMBA |
|---|---|---|---|
| Water (for comparison)* | protic | 78.85 | 4.4 |
| Methanol | protic | 32.08 | 9.63 |
| Isopropanol | protic | 18.3 | 11.6 |
| Dimethylsulfoxide | aprotic | 48.9 | 11.46 |

TABLE 4-continued

| Potential Active Agent** | Type | Dielectric Constant | pKa, 3,4-DMBA |
|---|---|---|---|
| Dimethylformamide | aprotic | 36.71 | 12.7 |
| Acetone | aprotic | 20.7 | 18.71 |
| Aniline | aprotic | 6.89 | 21.05 |

Notes:
*Water is not an active agent but is used for comparison purposes. Water may be used as a modifier for the active agent;
**Those compounds which have suitable solubility in the hydrocarbon feed at selected operating conditions may be suitable active agents.

In various embodiments, preferable active agents may have the following properties:

1. Have a dielectric constant which is between the dielectric constant values for the hydrocarbon feed and water;
2. Have generally low solubility in the acidic hydrocarbon feed at selected operating conditions (e.g., when the enriched active agent phase is separated from the acidic hydrocarbon feed depleted in the acidic constituent);
3. Have generally low solubility for the hydrocarbon feed; and
4. Are protic in nature and able to hydrogen-bond with the acidic constituent and to cause the acidic constituent to dissociate.

In various embodiments, the dielectric property of a suitable active agent may range in value between the dielectric property value of the acidic hydrocarbon feed and the dielectric constant of pure water at particular processing conditions. For example, the dielectric property value of the active agent may range between the dielectric constant of bitumen diluted (dilbit) in naphtha at 20° C. (i.e., a value of about 3) and the dielectric constant of water at 25° C. (i.e., a value of 78.85).

In various embodiments, the degree of solubility of the active agent in the acidic hydrocarbon feed may be modulated by modulating the properties (e.g., composition) of the active agent, the operating parameters (e.g., temperature, pressure, time parameters) or a combination thereof prior to contacting the active agent with the acidic hydrocarbon feed, and at any stage of the process. Various active agent modulating means may be used to modulate the properties of the active agent such as, for example, a chamber comprising an inlet and a valve for metered introduction of one or more active agents (e.g., recycled active agent, new agents) and modifiers to produce a suitable composition of the active agent for treating a particular acidic hydrocarbon feed or a particular treated hydrocarbon material comprising residual acidic constituents under particular operating conditions or stages of the process. Examples of suitable modifiers are water and other active agents (e.g., protic compounds) with dielectric constants between about 3 and about 80 at 20° C. Different modulating means may be used at different stages of the process.

In various embodiments, the active agent may be a liquid, gas or a mixture of liquid and gas. For example, in selected embodiments, the active agent may be mixed with the acidic hydrocarbon feed as a liquid or permeated through the acidic hydrocarbon feed as a gas. In various embodiments, the phase of the active agent may be also modulated at various stages of the process. For example, initially the active agent may be introduced into the acidic hydrocarbon feed as a gas, and by modulating operating conditions such as the temperature for example, the active agent may be caused to become a liquid in the acidic hydrocarbon feed at a subsequent stage of the process.

In various embodiments, suitable active agents may comprise a protic active agent which may comprise one or more electronegative atoms (e.g., fluorine, oxygen, nitrogen or chlorine). In various embodiments, one or more dipolar aprotic compounds may be used if combined with the protic active agent to form an active agent composition having suitable solubility in the acidic hydrocarbon feed. In various embodiments, the protic active agent may comprise an alcohol (primary, secondary, tertiary), combinations of various alcohols, or alcohol/water mixtures having varying ratios of alcohol to water wherein water is a modifier and has a lower concentration compared to the total concentration of the active agent. Examples of suitable protic active agents include methanol, ethanol, propanol, butanol, pentanol, glycerol and various glycols (e.g., ethylene glycol), poly alcohols, a combination of various protic active agents, and a combination of various protic active agents with varying ratios of water as the modifier in order to tailor the chemical properties of the active agent to the properties of the particular acidic hydrocarbon feed to be treated (e.g., to modulate degree of solubility of the active agent in the acidic hydrocarbon feed and the desired efficiency for reducing the content of the acidic constituent in the acidic hydrocarbon feed).

In various embodiments, alcohols suitable as active agents are alcohols having 1 to 6 carbon atoms. In various other embodiments, alcohols suitable as active agents are alcohols having 1 to 6 carbon atoms in a linear chain. In further various embodiments, alcohols suitable as active agents are alcohols having 1 to 4 carbon atoms. In various other embodiments, alcohols suitable as active agents are alcohols having 1 to 4 carbon atoms in a linear chain. In embodiments in which the active agent composition comprises alcohols having more than 6 carbon atoms, such compositions preferentially comprise sufficient amounts of alcohols having 1 to 6 carbon atoms such that the composition has a suitable solubility in the acidic hydrocarbon feed.

In various other embodiments, a succession of active agents may be used to further treat the treated hydrocarbon material in one or more stages to further extract any acidic constituents remaining after the treatment of the acidic hydrocarbon feed with the active agent.

The amount of the active agent required to treat the acidic hydrocarbon feed will be at least the amount of the active agent required to effect a reduction in the content of the acidic constituent in the acidic hydrocarbon feed such that the resultant treated hydrocarbon material has a content of the acidic constituent that is less than the initial acidic constituent content that was present in the acidic hydrocarbon feed used as feedstock for the process of the present invention. In various embodiments, the resultant content of the acidic constituent may be substantially less than the initial content of the acidic constituent. This allows for the treated hydrocarbon material to be processed downstream (e.g. by an upgrader) to produce downstream products. For illustration purposes, in various embodiments, the resultant content of the acidic constituent in the treated hydrocarbon material may be represented by TAN ranging from 0.1 mg-KOH/g-oil or less to about 0.5 mg-KOH/g-oil. In other embodiments, the resultant content of the acidic constituent may be more than about 0.5 mg-KOH/g-oil depending on the acceptable tolerance for contaminants in the hydrocarbon material in various commercial applications.

In various embodiments, the active agent composition comprising a mixture of the active agent and a modifier such as water may have a concentration of the active agent in the mixture ranging from about 99.9 wt. % to about 99 wt. %, about 99 wt. % to about 90 wt. %, about 90 wt. % to about 80 wt. %, about 80 wt. % to about 70 wt. %, about 70 wt. % to about 60 wt. %, or about 60 wt. % to about 50 wt. %. Suitable concentration of the active agent for treating the acidic hydrocarbon feed will depend on the composition of the acids in the feed (e.g., types of acids, amounts).

In various embodiments, suitable ratios of the active agent to the acidic hydrocarbon feed may be in the range of about 1:10 to about 2:1. Suitable ratios, however, may be further modulated depending on the properties of the active agent relative to the properties of the acidic hydrocarbon feed. In selected embodiments, economics of the process may be a factor in selecting a suitable ratio as higher ratios require larger process units and larger volumes of active agents to circulate. In various embodiments, the economic efficiency may be increased by recovering and recycling the active agent within the process because the active agent is not a consumable reagent.

A suitable amount of the active agent relative to the amount of the acidic constituent present in the acidic hydrocarbon feed is such that the effective weight percent of the acidic constituent in the active agent will be below the solubility limit of the acidic constituent in the active agent at the process conditions if all the acidic constituent in the acidic hydrocarbon feed were to be extracted into the active agent phase. In various embodiments, the mass ratio of the active agent to the acidic hydrocarbon feed may be, depending on the acidic constituent solubility in the active agent, at least about 1 times to about 100 times of the mass ratio of the acidic constituent present in the acidic hydrocarbon feed.

In various embodiments, the volume ratio of the components in the active agent composition comprising a mixture of an active agent with another active agent or with water is such that the sum of volume fraction ($V_i$) multiplied by dielectric constant ($\in_i$) for the active agent (where i=1 to n for active agent component 1, 2, 3, etc.) and water falls between the values of the dielectric constants of the acidic hydrocarbon feed ($\in_h$) and water ($\in_w$) at process conditions. This is expressed mathematically by Formula 4.

$$\varepsilon_h < \sum_i \varepsilon_i V_i < \varepsilon_w \qquad \text{(Formula 4)}$$

A second suitable mixture of the active agents, or the active agent and water, is such that the resulting dielectric constant of the mixture when compared to a first suitable mixture is within about plus or minus five units at the same process conditions.

Suitable active agents for use in various embodiments may be identified as those having one or more of the following properties: good solubility for the acidic constituents (e.g., for naphthenic acids) particularly at low active agent/acidic hydrocarbon feed ratios; high density contrast with the acidic hydrocarbon feed to facilitate rapid gravity separation; minimal stable emulsion formation tendency with the acidic hydrocarbon feed to facilitate rapid separation from the treated hydrocarbon material; relatively low mutual solubility with the acidic hydrocarbon feed at selected operating conditions to facilitate high recovery of the active agent from the treated hydrocarbon material; suitable viscosity for effective mixing and contacting with the acidic hydrocarbon feed; comprise substantially no harmful hetero-atoms for benign downstream processing; have suitable dielectric constants (polarity) at selected operating conditions relative to the particular acidic hydrocarbon feed to be processed at the selected operating conditions and stages of the process; and do not form undesirable by-products with the species found in the acidic hydrocarbon feed. Table 5 shows examples of active agents having certain dielectric constants, which may be suitable for treating acidic hydrocarbon feeds to effect a reduction in the content of the acidic constituents.

TABLE 5

| Potential Active Agent | Dielectric Constant* | Relative Polarity |
|---|---|---|
| Water (for comparison)** | 78.85 | Most polar |
| Glycerol | 42.5 | |
| Ethylene glycol | 37.7 | |
| Methanol | 32.63 | ⇩ |
| Ethanol | 24.3 | |
| 1-propanol | 20.1 | |
| 1-butanol | 17.1 | |
| 1-pentanol | 13.9 | |
| Hydrocarbon feed (dilbit) (for comparison) | 3.7 | Least polar |

Notes:
*Approximate values at 25° C.;
**Water is used in various embodiments as a modifier and not as an active agent.

In various embodiments, active agents exhibiting one or more of the above properties may be further modified with other active agents, or water, or other chemical compounds (e.g., demulsifiers, ionic salts, reagents for reaction with TAN acids such as alkalis), or a combination thereof to achieve chemical properties that will allow to obtain the desired levels or efficiencies of reducing the content of the acidic constituents in the particular acidic hydrocarbon feed under particular operating conditions, particular stages of the process or a combination thereof.

In various embodiments, one or more active agents may be present in the input acidic hydrocarbon feed which may subsequently combine with additional active agents added to the acidic hydrocarbon feed or with the treated hydrocarbon material to achieve an active agent mixture with properties (e.g., dielectric constant) suitable for achieving a reduction in the content of the acidic constituents under the particular operating conditions or stages of the process.

In various embodiments, the treatment of the acidic hydrocarbon feed or of the treated hydrocarbon material with the active agent may be performed in one or more stages, using process conditions tailored to the properties of the acidic hydrocarbon feed or of the treated hydrocarbon material at each stage, to achieve progressive reduction in the content of the acidic constituents, phase separation, or a combination thereof.

In various embodiments, the time parameter required to effect the dissolution of the acidic constituent in the active agent and to form the separable enriched active agent phase will be such that a desired equilibrium is met under particular operating conditions. In various embodiments, for example, the time parameter may range from less than about 1 minute to less than about 8 hours. In other embodiments the time parameter may range from about 5 minute to about 1 hour. In yet other embodiments, the time parameter may range from about 1 hour to about 3 days. In yet other embodiments, the time parameter may range from about 3 days to one or a plurality of weeks.

In various embodiments in which the acidic hydrocarbon feed comprises various salts or salt-forming species in addition to the acidic constituents, the reduction in the content of the acidic constituents may also result in the reduction in the content of the salts or the salt forming species, if the salts or the salt-forming species also have a solubility in the active agent greater than the solubility in the acidic hydrocarbon feed. In various embodiments, the extent to which the content of the salts or the salt-forming species may be reduced in the acidic hydrocarbon feed will vary depending on the solubility of the salts and the salt forming species in the active agent at the particular operating conditions. In various embodiments, the treatment of the acidic hydrocarbon feed may be repeated on the treated hydrocarbon material using the same or different active agents and operating conditions to achieve a desired level of the reduction in the concentration of the acidic constituents, the salts or salt forming species, or a combination thereof.

Referring to FIG. 1, there is shown a schematic diagram of a system 10 according to one embodiment for treating an acidic hydrocarbon feed 12 having a high TAN using an active agent 14 to reduce the content of the acidic constituents and produce a treated hydrocarbon material 16 having a low TAN. In this embodiment, the acidic hydrocarbon feed 12 is contacted with the active agent 14, which may comprise a make-up active agent 18 and a recycled active agent 20, in an extractor 22. Following the treatment of the acidic hydrocarbon feed 12 with the active agent 14, the treated hydrocarbon material 16 (also referred to as the hydrocarbon material depleted in the acidic constituent) is separated from the separable enriched active agent phase 24. The separable enriched active agent phase 24 may be further processed to produce the recycled active agent 20 for re-use within the system 10.

Figure 2:
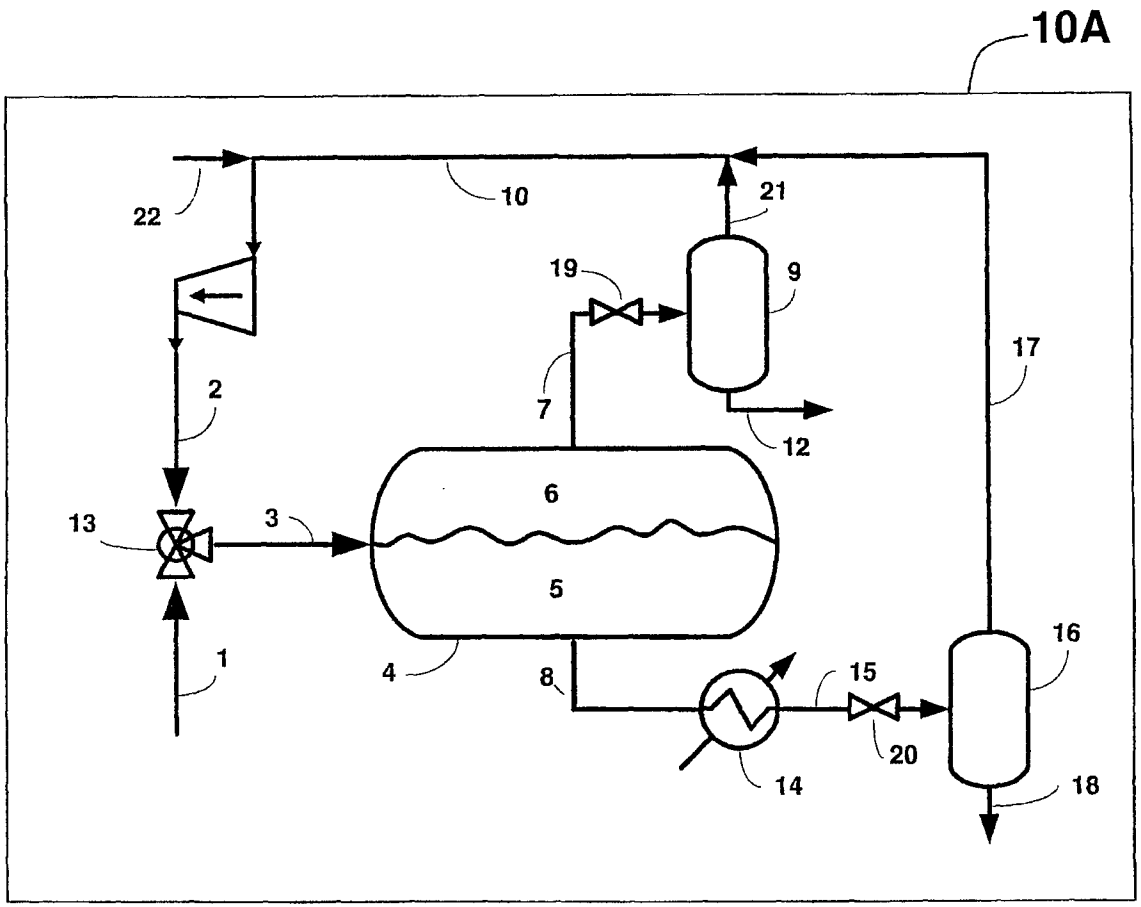
FIG. 2 illustrates a schematic diagram of system 10A according to another embodiment of the invention.

Referring to FIG. 2, there is shown a system 10A according to another embodiment adapted for treating the acidic hydrocarbon feed with the active agent to effect a reduction in the content of the acidic constituents in the feed. In the embodiment illustrated in FIG. 2, the acidic hydrocarbon feed is introduced through line 1 and the active agent is introduced through line 2, in a counter-current or co-current manner, into a mixing valve or contactor 13 where turbulence is sufficient to produce a mixed feed having the active agent phase substantially dispersed, fully or partially dissolved, or a combination thereof in the acidic hydrocarbon feed to a desired degree. The active agent introduced into the contactor 13 has a flow rate that achieves sufficient dispersion, dissolution or a combination thereof of the active agent in the acidic hydrocarbon feed. In this embodiment, the active agent and the acidic hydrocarbon feed may also have any suitable temperatures so long as the pressure is sufficiently high to maintain the active agent and the acidic hydrocarbon feed in the liquid phase, or in a gaseous phase or a combination thereof in various other embodiments, and to maintain the desired degree of solubility of the active agent in the acidic hydrocarbon feed at the selected operating conditions. In various embodiments, mixing of the active agent with the acidic hydrocarbon feed may also be effected using mixing means comprising static mixers, injectors, nozzles or tank mixers with impellers, turbines, propellers or paddles, or other high shear mechanical devices with or without energy input (e.g. thermal energy). Any mixing means is suitable for use in the various embodiments (e.g., an inline device) as long as effective distribution, dissolution or both distribution and dissolution of the active agent within the acidic hydrocarbon feed, including the hydrocarbon-water interface, may be achieved.

In the embodiment shown in FIG. 2, the mixed feed comprising the active agent is carried through line 3 into a separator 4, where conditions (temperature, pressure, time and hydrodynamics) are such that liquid-liquid phase separation occurs within a certain time to produce a separable enriched active agent phase 6 (e.g., the acid constituent in the enriched active agent phase 6 may exist, for example, in an acidic or neutralized form), and the treated hydrocarbon material 5 depleted in the acidic constituent, the treated hydrocarbon material 5 being distinct from the enriched active agent phase 6 depending on the number of stages in the process. In selected embodiments, the enriched active agent phase 6 may either float on top of the treated hydrocarbon material 5 or vice versa depending on the choice of the active agent for a particular treatment. In various embodiments, active agent dissolved in the acidic hydrocarbon feed may also be separated from the treated hydrocarbon material at selected conditions. Table 6 shows densities of various active agents relative to the density of the hydrocarbon material (dilbit in this example).

TABLE 6

| Potential Active Agent | Dielectric Constant | Density (ρ) (g/mL) | Δρ (active agent—hydrocarbon feed) | |
|---|---|---|---|---|
| Water (for comparison) | 78.85 | 1.00 | 0.06 | ⇧ |
| Glycerol | 42.5 | 1.26 | 0.32 | |
| Ethylene glycol | 37.7 | 1.11 | 0.17 | Hydrocarbon feed floats |
| Methanol | 32.63 | 0.79 | −0.15 | Hydrocarbon feed sinks |
| Ethanol | 24.3 | 0.79 | −0.15 | |
| 1-propanol | 20.1 | 0.80 | −0.14 | |
| 1-butanol | 17.1 | 0.81 | −0.13 | |
| 1-pentanol | 13.9 | 0.82 | −0.12 | ⇩ |
| Hydrocarbon feed (dilbit) (for comparison) | 3.7 | 0.94 | 0.00 | |

Notes:
Water is used in various embodiments as a modifier and not as an active agent.

In various other embodiments, the active agent and the acidic hydrocarbon feed may also be contacted directly in the separator 4 for both mixing and subsequent separation. Examples of separators suitable for use in various embodiments of the present invention include conventional separators such as for example an inclined plate separator, a tank, or dynamic separators, including an inline device. Enhanced gravity separators such as centrifuges and hydrocyclones are also useful where space is limited or more intense dispersion of the active agent in the dehydrated and salty hydrocarbon feed is utilized.

In selected embodiments, staged mixing and separation may take place with the addition of one or more of the active agents at each stage to tailor the properties of the active agent to the changing properties of the acidic hydrocarbon feed or of the treated hydrocarbon material to maximize the reduction in the content of the acidic constituents. Furthermore, operating conditions may be adjusted at each stage to maximize the efficiency of the active agent at each of the processing stages.

In the embodiment shown in FIG. 2, the enriched active agent phase 6 exits the separator 4 through line 7 and through a valve 19 into an active agent phase separator 9 for recovery where the enriched active agent phase 6 may be further processed in a conventional manner (e.g., distillation) to obtain a recovered active agent. As is shown in the embodiment in FIG. 2, in some embodiments, the acidic constituents (e.g., naphthenic acids) may also be recovered through line 12 from the bottom of the active agent phase separator 9. The recovery may be performed, for example, by using water to precipitate the less polar acidic constituents from the active agent or by cooling the mixture. The recovered active agent exits the active agent phase separator 9 through line 21 for further processing, reuse within the system 10A, disposal or other uses. In the embodiments in which the recovered active agent is recycled into the system 10A, make-up active agent, modifiers or both may be added to the system 10A through line 22 as is illustrated in FIG. 2 for example to modulate the properties of the recovered active agent, or alternatively the recovered active agent may be used to modulate the properties of the make-up active agent.

In various embodiments, the enriched active agent phase 6 may comprise a content of the acidic constituents in the range from about the limiting acidic constituent solubility in the active agent at stream conditions to TAN value of about 0.5 mg-KOH/g-active agent depending on the ratio of active agent to the acidic hydrocarbon feed and the content of acidic constituents in the acidic hydrocarbon feed.

In the embodiment in FIG. 2, the treated hydrocarbon material 5 depleted in the acidic constituents is heavier than the separable enriched active agent phase 6 (i.e., the used active agent phase 6), and exits the separator 4 through line 8. In selected embodiments, the treated hydrocarbon material 5 may be warmed using a heat exchanger 14 for example. The treated hydrocarbon material 5 may be further sent to a treated hydrocarbon material separator vessel 16 for recovery of hydrocarbons through line 18 for example, in which any residual active agent may be stripped, for example, by heating. In various embodiments the treated hydrocarbon material 5 (also referred to as a hydrocarbon material depleted in the acidic constituent) may comprise a content of the acidic constituents in the range of TAN of about 0 to about 1 mg-KOH/g-oil or less depending on the level of removal of the acidic constituents desired. In various embodiments, salts or salt-salt forming species may also be extracted together with the acidic constituents as described above.

Figure 3:
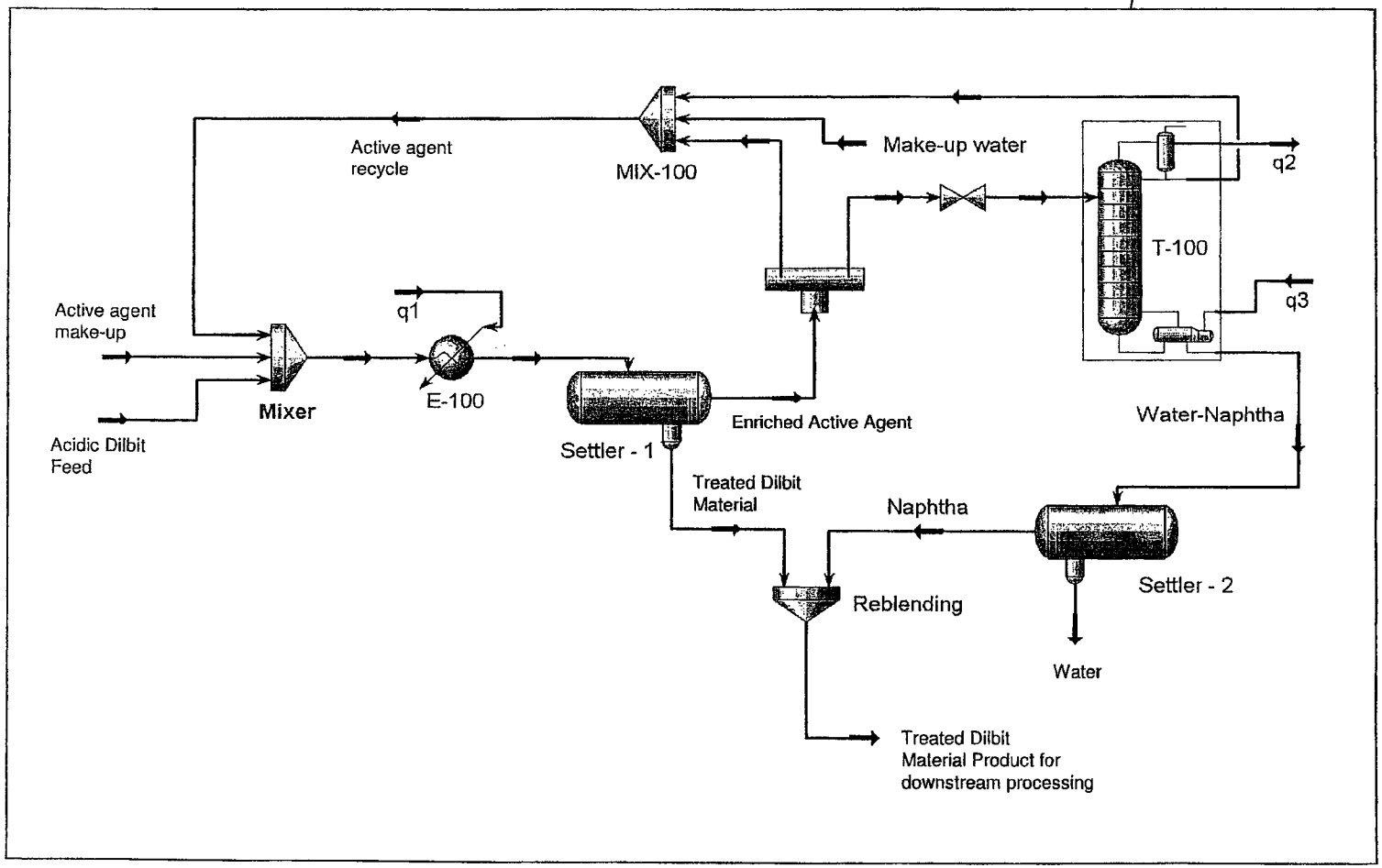
FIG. 3 illustrates a schematic diagram of system 10B according to another embodiment of the invention.
Figure 4:
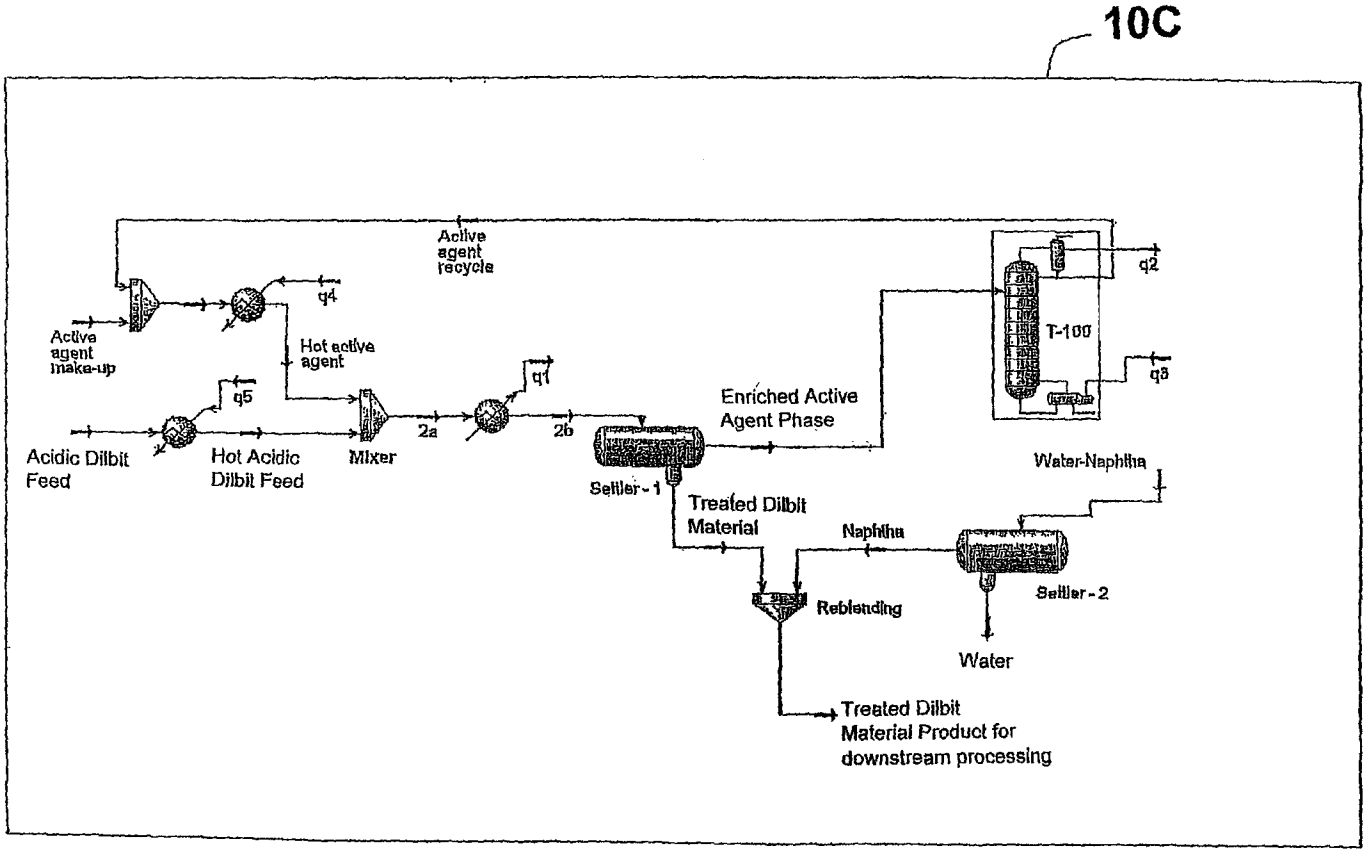
FIG. 4 illustrates a schematic diagram of system 10C according to another embodiment of the invention.

FIG. 3 shows another embodiment (system 10B) with acidic dilbit (diluted bitumen) as an example of the acidic hydrocarbon feed and a particular processing circuit design. In the embodiment shown in FIG. 3, only a portion of the separable enriched active agent phase is treated, for example to remove the acidic constituents, while the remainder which is under-saturated with the acidic constituents is recycled into the process. FIG. 4 (system 10C) shows another embodiment with the acidic dilbit and a particular processing circuit design wherein hot acidic dilbit and hot active agent are mixed (stream 2*a*) so that the active agent is substantially dissolved in the acidic dilbit followed by another stage where the stream is cooled, so that the active agent is no longer soluble in the treated dilbit, prior to entering a separator.

Figure 5:
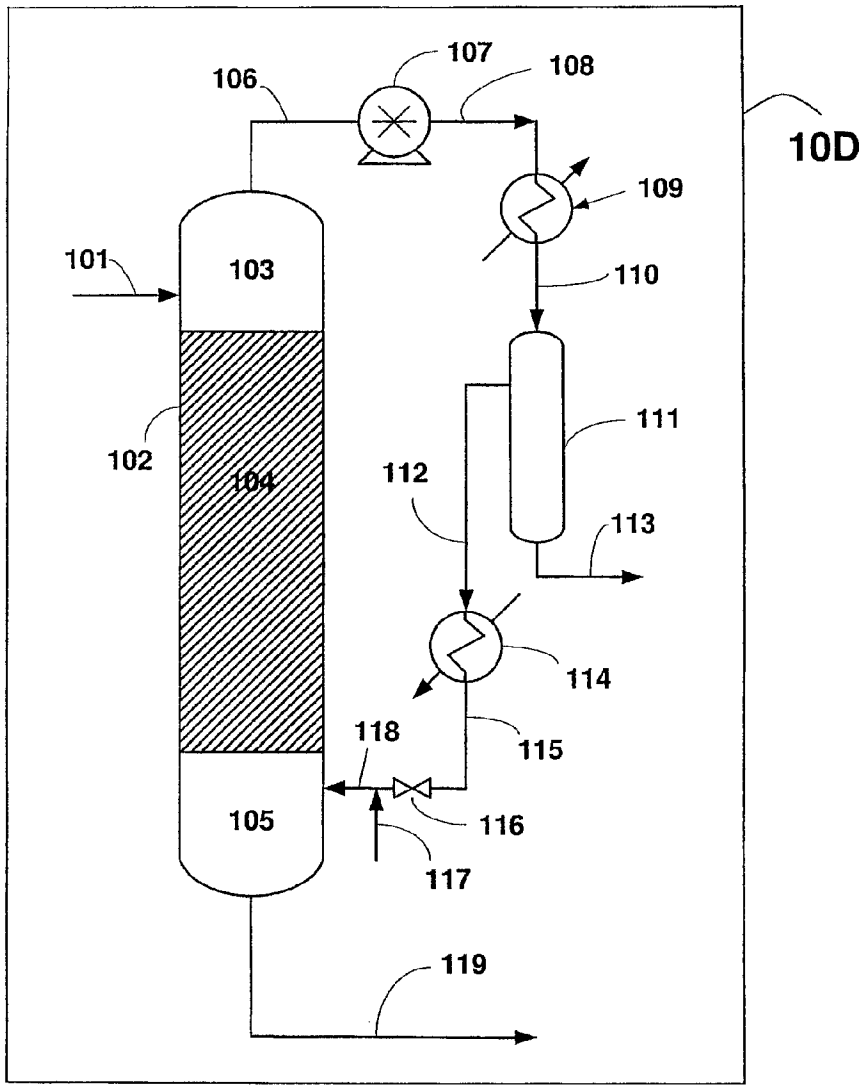
FIG. 5 illustrates a schematic diagram of system 10D according to another embodiment of the invention.

In yet another embodiment, as shown in FIG. 5 (system 10D), the acidic hydrocarbon feed is introduced through line 101 into a counter-current liquid-liquid contactor 102. Contactor 102 may have an active agent disengagement zone 103 where the active agent is withdrawn above the point where the acidic hydrocarbon feed is introduced, packing, trays or other types of column internals 104 to enhance contacting of the acidic hydrocarbon feed with the active agent, and a disengaging zone 105 where the active agent is introduced above the disengagement zone such that the treated hydrocarbon material depleted in acidic constituents (and in some embodiments in salt or salt forming species) can be withdrawn following separation within a certain time. Suitable packing 104 may include unstructured or dumped packing (e.g., saddles and rings), structured or arranged packing (e.g., trays, cartridge and grids). The packing 104 may be chosen to further enhance the removal of the acidic constituents (and in some embodiments in salt or salt forming species) in addition to the action of the active agent and the influence of operational parameters. The active agent may enter the contactor 102 through line 118 while a make-up active agent may enter through line 117. Due to density differences between the active agent and the acidic hydrocarbon feed, the more dense feed may flow down the contactor 102 and the less dense active agent may rise upward through the contactor 102 resulting in the active agent contacting the acidic hydrocarbon feed for treatment. In embodiments where the active agent is more dense than the acidic hydrocarbon feed, the active agent may be introduced into zone 103, the feed may be introduced into zone 105, and the active agent recovery is reconfigured accordingly.

In another aspect, various configurations of the contactor 102 may be employed including (1) single or multiple stages of conventional mixer settler vessels, (2) pulsed columns, (3) mechanically agitated columns and (4) centrifugal extractors in a variety of operational modes (e.g., once-through mode or continuous recycle mode). In various embodiments, one or more contactors 102 may be used in various configurations to effect tailored processing including staged processing of various acidic hydrocarbon feeds having various contents of the acidic constituents.

In the embodiment shown in FIG. 5, the separable enriched active agent phase following separation (i.e., the used active agent phase) exits the contactor 102 through line 106 which may be connected to a pump 107. The separable enriched active agent phase enters an active agent phase separator 111 in which the acidic active agent phase may be further processed. The recovered active agent exits the separator 111 through line 112 for further processing, recycling into the system 10D, disposal, or other use. The acidic constituent exits through line 113 to waste disposal or for other uses.

EXAMPLES

High-Shear Mixer Settler

A preliminary evaluation of the potential of using various compositions comprising methanol as the active agent for reducing the content of acidic constituents in the acidic hydrocarbon feed such as diluted bitumen was undertaken on a laboratory scale by employing mixing and settling tests. For example, for each test, known masses of the methanol and the diluted bitumen were added to a 250 mL beaker to achieve a specified volumetric ratio of methanol to diluted bitumen. The methanol and diluted bitumen were mixed for a selected time period using a magnetic stirrer at a selected substantially constant temperature to form a mixture in which the methanol is substantially distributed throughout the diluted bitumen to achieve contacting of methanol with the acidic constituents in the diluted bitumen. After forming the mixture, the mixture was allowed to stand for a selected period of time to effect a transfer of the acidic constituents from diluted bitumen into the methanol and to form a separable enriched methanol phase enriched in acidic compounds and a treated bitumen material depleted in acidic compounds. Table 7 summarizes the results for treating diluted bitumen with methanol to reduce the content of the acidic constituents from the bitumen under various experimental conditions including temperature, contact time, and methanol to bitumen ratios. The separable enriched methanol phase enriched in acidic compounds appeared to have a yellow colour and was lower in density as compared to the treated bitumen material. This separable enriched methanol phase was therefore recovered as the upper phase and weighed, and the treated bitumen material was recovered as the bottom phase.

As is indicated by the data in Table 7, methanol is an example of a suitable active agent for reducing the TAN of diluted bitumen, and also for reducing the content of chlorides in the diluted bitumen at various operating conditions.

TABLE 7

| Sample | T (° C.) | Contact Time (hrs) | Methanol/ Dilbit* (vol/vol) | Mass Balance % | Methanol Recovery % | Dilbit Loss[d] % | Cl[a] (ug/g) | TAN (mgKOH/g) |
|---|---|---|---|---|---|---|---|---|
| Dilbit feed | — | — | — | — | — | — | 6.53 | 2.13 |
| 1 | 22.4 | 24 | 2:1 | 99.5 | 103.9 | 6.5 | 2.01 | 1.61 |
| 2-1 | 25.1 | 1 | 2:1 | 99.7 | 105.4 | 9.1 | 2.31 | 1.68 |
| 2-2[b] | 24.8 | 1 | 2.8:1 | 99.7 | 80.6 | — | 1.76 | 0.67 |
| 3 | 50.6 | 1 | 2:1 | 99.6 | 106.0 | 10.0 | 2.04 | 1.51 |
| 4 | 61.0 | 1 | 2:1 | 99.6 | 106.6 | 11.1 | 1.69 | 1.46 |
| 5 | 27.6 | 1 | 1:10 | 99.5 | 0.0[c] | — | 6.01 | 2.06[c] |
| 6 | 25.0 | 1 | 1:1 | 99.8 | 104.3 | 3.6 | 3.11 | 1.69 |
| 7 | 24.4 | 1 | 1.5:1 | 99.6 | 105.0 | 6.3 | 2.95 | 1.60 |

Notes:
*The term "dilbit" denotes diluted bitumen;
[a]Methanol as received contained about 0.3 ug/g of chloride;
[b]The treated bitumen material from Run 2-1 was treated with a fresh aliquot of methanol;
[c]Methanol was dispersed in the dilbit but was not dissolved as it could be separated by centrifugation;
[d]Lost to active agent (methanol) phase.

As is shown in Table 7, the TAN was reduced from about 2.13 mg-KOH/g to a range of about 0.67 mg-KOH/g to about 2.06 mg-KOH/g at variable operating conditions. The chloride content was reduced from about 6.53 μg/g to a range of about 1.69 μg/g to about 6.01 μg/g at variable operating conditions. Both the temperature and the ratio of the active agent to the acidic hydrocarbon feed appear to be important in achieving an increased reduction in the TAN and in the chloride content. Under the particular conditions studied, a higher temperature appears to resulted in an increased reduction in the content of the acidic constituents in the feed. As was evidenced by the colour of the separable enriched methanol phase, a portion of the diluted bitumen was soluble in the methanol. The solubility of diluted bitumen in methanol was estimated from methanol recoveries assuming no loss of methanol to the diluted bitumen. As is indicated by the results in Table 7, the solubility of the diluted bitumen in methanol appears to increase slightly with temperature, and decrease with decreasing ratio of methanol to diluted bitumen. At a ratio of about 1:10 methanol to diluted bitumen, the methanol was substantially dispersed in the oil and did not separate on standing under normal gravity, but did separate under enhanced gravity field in a centrifuge.

In various embodiments, the acidic hydrocarbon feed may be treated with the active agent, and the resultant treated hydrocarbon material may be subsequently treated again with another aliquot of the active agent. For example, as is shown in Table 7, the treated bitumen material (sample 2-1) was contacted with methanol at a ratio of about 2:1 methanol to treated bitumen material at 25° C., and the resultant treated bitumen material (sample 2-2) was again contacted with a second aliquot of fresh methanol. As is indicated by the data in Table 7, the treated bitumen contacted with the methanol in two successive steps (sample 2-2) had both the TAN and the chloride content further reduced as compared to the treated bitumen obtained from contacting with methanol only once (sample 2-1). As is shown in Table 7, the TAN content was reduced in the acidic bitumen material from about 2.13 mg-KOH/g-hydrocarbon to about 1.68 mg-KOH/g-hydrocarbon with the first aliquot of methanol to produce the treated bitumen material, and in the treated bitumen material from about 1.68 mg-KOH/g-hydrocarbon to about 0.67 mg-KOH/g-hydrocarbon with the second aliquot of methanol. Thus, in various embodiments, the acidic hydrocarbon feed and the resultant treated hydrocarbon material may be both contacted with the active agent having similar or different composition for each treatment and under similar or different operating conditions to increase the removal of acidic constituents from the acidic hydrocarbon feed and from the treated hydrocarbon material.

Figure 6:
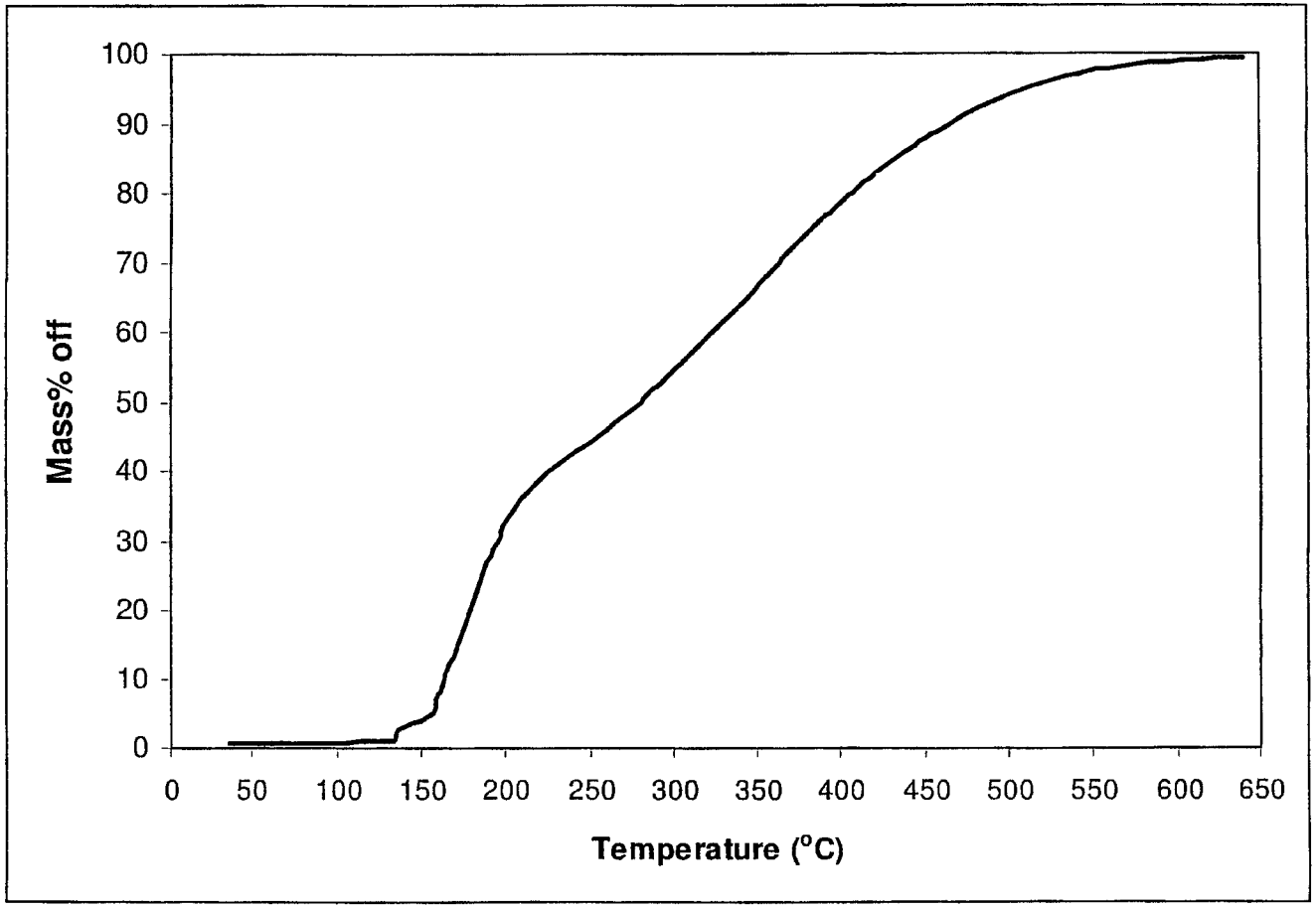
FIG. 6 shows the results of a simulated distillation of material extracted with methanol at 25° C. from bitumen using the system and process of the present invention.

Diluted bitumen contacted with methanol at about 25° C. from a test with a ratio of methanol to diluted bitumen of about 2:1 (sample 2-1) was separated from the methanol-diluted bitumen mixture and analyzed. In this test, a maximum of about 5.4 wt. % of diluted bitumen dissolved in methanol at 25° C. The fraction of the initially charged diluted bitumen which was extracted by methanol was about 9.1 wt. %. The recovered methanol phase was subjected to spinning band distillation in order to remove the methanol leaving only that part of the diluted bitumen that was dissolved in the methanol. FIG. 6 represents a simulated distillation curve for the methanol-free bitumen fraction. As is indicated in FIG. 6, the methanol-free bitumen fraction appears to consist of about 12% naphtha (BP<166° C.), about 36% kerosene (BP166-271° C.) and gas oils plus about 3% of +525° C. residue. The methanol-free bitumen fraction had a TAN of about 8.4 mg-KOH/g-hydrocarbon which was consistent with the observed reduction in TAN of the treated diluted bitumen.

Static Mixer-Settler

Following the laboratory beaker tests described above, a batch static mixer-settler apparatus was used to perform TAN reduction tests of diluted bitumen as the acidic hydrocarbon feed using methanol as the active agent. Seven tests were conducted at temperatures of 25° C., 50° C., and 70° C. with methanol to diluted bitumen ratios of about 1:10, about 1:1, and about 2:1. Table 8 summarizes the results for these tests.

In these particular examples, methanol and diluted bitumen were pumped from two separate heated reservoirs at suitable flow rates to achieve the desired volumetric ratio of the two fluids upon contact. The two fluids flowed co-currently into a series of fourteen static mixers where, upon contact, the fluids were mixed and, if needed, further heated to the desired temperature.

TABLE 8

| Parameters | Hydrocarbon Sample | | | | | | | |
|---|---|---|---|---|---|---|---|---|
| | Dilbit | DBC 02 | DBC 03 | DBC 04 | DBC 05 | DBC 06 | DBC 07 | DBC 08 |
| Methanol/dilbit (vol/vol) | untreated | 1:1 | 2:1 | 1:1 | 1:10 | 1:1 | 2:1 | 1:10 |
| T (° C.) | untreated | 50 | 50 | 70 | 70 | 25 | 25 | 25 |
| TAN (mg KOH/g) | 2.13 | 1.31 | 1.23 | 1.68 | 1.31 | 0.94 | 1.65 | 2.32 |
| [Cl] (μg/g) | 7.05 | 2.01 | 1.54 | 2.01 | 4.85 | 2.35 | 3.44 | 5.39 |
| Average dP during collection (kPa)* | | 48.1 | 115.8 | 25.7 | 11.4 | 142.0 | 292.9 | 74.3 |
| **Dilbit viscosity (cP) at 50° C. | 112.6 | 249.2 | 470.4 | 235.6 | 149.2 | — | — | — |

Notes:
*dP denotes pressure drop across a capillary tube through which the dilbit flows during recovery from the settling vessel;
**The term "dilbit" denotes diluted bitumen.

The total residence time for mixing in the static mixers was about 14 minutes for all tests performed. After exiting the static mixer, the mixed fluid comprising methanol distributed throughout the bitumen was sent to a settling vessel maintained at the same temperature as the temperature of mixing. In the settling vessel, the two phases were allowed to separate under quiescent conditions for about 3 hours to form a separable enriched methanol phase enriched in the acidic constituents and a treated bitumen material depleted in the acidic constituents. Following the settling period, the separable enriched methanol phase and the treated bitumen material were discharged into separate collection vessels.

As is shown in Table 8, at 50° C., a ratio of about 1:1 of methanol to diluted bitumen results in a reduction in the content of the acidic constituents in the acidic bitumen feed. In comparison, at 70° C., a much lower ratio of methanol to diluted bitumen (i.e., about 1:10) appears to be effective for reducing the content of the acidic constituents. A methanol to diluted bitumen ratio of about 1:10 did not result in complete dispersion of the methanol in the bitumen phase at 70° C. using static mixers as compared to the results obtained from using high shear mixer at 27.6° C. discussed above. This was likely due to the lower shear mixing conditions in the static mixer. In the lower shear mixing conditions at 25° C., methanol to diluted bitumen ratio of about 1:1 was more effective than a ratio of about 2:1 while a ratio of about 1:10 was ineffective. Thus as was demonstrated by the results obtained from the high shear and low shear mixing, in some embodiments, depending on the processing conditions, a relatively low ratio of the active agent to the acidic hydrocarbon feed may be effective at reducing the TAN of the acidic hydrocarbon feed whereas in other embodiments, a higher ratio may be preferred.

Since viscosity is a function of temperature and affects mixing behaviour, in some embodiments, lower viscosity may be required to achieve effective contacting of the active agent with the acidic hydrocarbon feed and reduction in TAN. In embodiments in which the ratio of the active agent to the acidic hydrocarbon feed diluted with another hydrocarbon (e.g., naphtha) is relatively high, more active agent is available for extracting the diluent hydrocarbon, which may increase the viscosity of the acidic hydrocarbon material, resulting in poorer mixing, contacting, and therefore poorer removal of the acidic components form the acidic hydrocarbon feed. The results in Table 8 also show the impact of temperature and of the ratio of the active agent to the acidic hydrocarbon feed on the viscosity of the acidic hydrocarbon feed (proportional to average dP during oil recovery).

Addition of an Additive as a Modifier of the Active Agent to Improve TAN Reduction In various embodiments, in the process to reduce the TAN of the hydrocarbon feed, it may be desirable that only the TAN acids and inorganic chlorides or both the TAN acids and chlorides are extracted into the active agent, and that substantially no other valuable portion of the hydrocarbon feed be extracted. In various embodiments, it may be also desirable that the solubility of the TAN acids in the active agent be as high as possible so that the smallest volume of the active agent suitable for reducing the TAN can be used. In various embodiments, the active agent may be combined with additives to alter the properties of the active agent. For example, in various embodiments, the active agent may be combined with:

(1) One or more ionic salts so as to increase the ionic strength of the active agent. In this embodiment, the ionic salt dissolves in the active agent so as to alter the solubility of the active agent in the acidic hydrocarbon feed and vice versa. Depending on the altered solubility of the active agent in the acidic hydrocarbon feed, and the solubility of the acidic constituents in the altered active agent, the reduction in acidity of the acidic hydrocarbon feed may be modulated;

(2) One or more non-aqueous basic additives such as NaOH that react with and bind TAN acids to enhance the extraction of the TAN acids into the active agent phase from the acidic hydrocarbon feed.

In the above embodiments, the non-aqueous nature of the additive and the active agent composition, substantially avoids emulsification of the acidic hydrocarbon feed.

In various embodiments, the acidic constituents in the acidic hydrocarbon feed such as bitumen vary in size and composition. In various embodiments, suitable active agents may be used to treat the hydrocarbon feed to extract the smaller acidic constituents within a selected size range. Subsequently, the active agent modified with the additive (i.e., a non-aqueous active agent-additive composition) may be used to extract the remaining larger acidic constituents without resulting in the formation of an emulsion.

Three experiments were performed to evaluate the effect of the addition of the non-aqueous additive to the active agent on TAN reduction. About 68.6 g of dilbit was treated with about 58.2 g of methanol as the active agent, with or without the addition of the additive (e.g., a salt such as $Na_2SO_4$ or a base compound such as NaOH). The active agent-additive composition was gently mixed with the hydrocarbon feed (about 1:1 vol./vol.) at about 25° C. in, for example, a baffled reactor vessel for about 30 minutes and then allowed to settle for about 2 hours at the same temperature. Once the mixing was stopped, the two phases began to separate and a relatively distinct interface was observed. The colour of the separable enriched active agent-additive phase (e.g., enriched methanol-$Na_2SO_4$ or methanol-NaOH phase) was noted, and a sample of the treated dilbit was analyzed to determine TAN. Table 9 summarizes the effect of additives in the active agent on TAN removal.

TABLE 9

| | | Charge (g) | | | TAN | Colour of Enriched Active Agent- |
|---|---|---|---|---|---|---|
| Test | Additive | Active Agent* | Dilbit | Additive | (dilbit phase) mg KOH/g | Additive Phase |
| Dilbit | — | — | — | — | 2.24 | — |
| E-1 | None | 58.22 | 68.56 | — | 1.61 | Yellow |
| E-2 | $Na_2SO_4$ | 57.98 | 68.57 | 0.03 | 1.59 | Bright yellow, cloudy |
| E-3 | NaOH | 59.21 | 68.4 | 0.82 | 0.11 | Dark yellow |

*Notes: The active agent used was methanol.

The results in Table 9 show that there appears to be substantially no reduction in TAN due to the addition of sodium sulphate to methanol relative to the TAN reduction achieved with methanol alone as the active agent, even though the slightly enriched methanol-sodium sulphate phase had a slightly different appearance than when pure methanol was used. In contrast, when non-aqueous sodium hydroxide was used as an additive in methanol, TAN appears to have decreased by about 95% from about 2.24 mg-KOH/g-oil to about 0.11 mg-KOH/g-oil, which is substantially higher than the reduction that was achieved with pure methanol and with methanol-sodium sulphate composition. In the "E-3" test, the colour of the enriched methanol-NaOH phase appeared to be significantly darker as compared to the colour in the other two tests.

It appears that the added sodium sulphate did not have a substantial effect on reducing TAN. The solubility of sodium sulphate in methanol is very low so the effective ionic strength (see Formula 5) of this solution was low compared to that with sodium hydroxide (0.0013 M vs. 0.1076 M).

$$1/2 < \sum_i m_i z_i^2 \qquad \text{(Formula 5)}$$

where:

$m_i$ is molar concentration of $i^{th}$ ion (mole/liter);

$z_i$ is charge on $i^{th}$ ion.

In contrast to various processes of the prior art in which an aqueous solution of sodium hydroxide forms a strong base and has the tendency to form an emulsion with the hydrocarbon feed because TAN acids present in the hydrocarbon feed will be converted by reaction with the sodium hydroxide base to form surfactants which stabilize emulsion, the present process, in various embodiments, does not result in stable emulsion formation when sodium hydroxide additive was dissolved in methanol as the active agent and contacted with dilbit. In the prior art, when sodium hydroxide is dissolved in water, it produces sodium and hydroxide ions, i.e., a strongly basic solution with a high pH. In the various embodiments, when sodium hydroxide is dissolved in methanol which is less polar than water, sodium and hydroxide ions are more closely associated as ion-pairs so that there are no free hydroxide ions, and pH has no physical meaning. Thus, when TAN acids are extracted into the methanol-sodium hydroxide non-aqueous composition, they therefore do not form surfactant emulsions.

Although specific embodiments of the invention have been described and illustrated, such embodiments should not to be construed in a limiting sense. Various modifications of form, arrangement of components, steps, details and order of operations of the embodiments illustrated, as well as other embodiments of the invention, will be apparent to persons skilled in the art upon reference to this description. It is therefore contemplated that the appended claims will cover such modifications and embodiments as fall within the true scope of the invention. In the specification including the claims, numeric ranges are inclusive of the numbers defining the range. Citation of references herein shall not be construed as an admission that such references are prior art to the present invention.

What is claimed is:

1. A method of processing an oil sands-derived acidic hydrocarbon feed for treatment downstream, the hydrocarbon feed comprising an acid and a hydrocarbon material, the method comprising:

(a) contacting the hydrocarbon feed under a first operating condition with a non-neutralizing fluid active agent, wherein the active agent does not neutralize the hydrocarbon feed and has an initial active agent solubility in the hydrocarbon feed and the acid has an acid solubility in the hydrocarbon feed;

(b) permitting a separable enriched active agent phase to form in the hydrocarbon feed under a second operating condition, wherein:

the active agent has a secondary active agent solubility in the hydrocarbon feed that is less than the initial active agent solubility, and the acid has a solubility in the active agent that is substantially greater than:

i) the acid solubility in the hydrocarbon feed under the first operating condition, and ii) the acid solubility in the hydrocarbon material under the second operating condition, such that the acid dissolves in the active agent; and (c) allowing the separable enriched active agent phase to separate from the hydrocarbon material depleted in the acid under the second operating condition.

2. The method of claim 1 wherein the initial active agent solubility in the hydrocarbon feed ranges from about 0.001 wt. % to about 0.01 wt. %, about 0.01 wt. % to about 1 wt. %, about 1 wt. % to about 5 wt %, or about 5 wt. % to about 10 wt. %.

3. The method of claim 1 wherein the acid comprises a naphthenic acid, hydrogen sulphide, a hydrochloric acid, a phenol, or a combination thereof.

4. The method of claim 3 wherein the acid further comprises a mercaptan.

5. The method of claim 1 wherein the acid solubility in the hydrocarbon feed ranges from about 0.001 wt. % to about 5 wt. %.

6. The method of claim 1 wherein the acid solubility in the active agent ranges from about 0.01 wt. % to about 50 wt. %.

7. The method of claim 1 wherein the hydrocarbon feed has a total acid number value ranging from about 0.01 to about 0.1 mg-KOH/g-oil, about 0.1 to about 3.5 mg-KOH/g-oil, about 3.5 to about 10 mg-KOH/g-oil or greater than about 10 mg-KOH/g-oil.

8. The method of claim 1 wherein the acid in the hydrocarbon feed has a concentration expressed by a total acid number ranging from about 0.5 to about 100 mg-KOH/g-oil.

9. The method of claim 1 wherein the separable enriched active agent phase is a distinct acidic active agent phase.

10. The method of claim 1 wherein the second operating condition is different from the first operating condition in temperature, pressure, time or a combination thereof.

11. The method of claim 1 wherein the active agent comprises a protic active agent.

12. The method of claim 11 wherein the protic active agent comprises an alcohol.

13. The method of claim 12 wherein the alcohol is an alcohol having 1 to 4 carbons.

14. The method of claim 13 wherein the alcohol having 1 to 4 carbons comprises a linear carbon chain.

15. The method of claim 13 wherein the alcohol is methanol.

16. The method of claim 1 wherein the active agent is a mixture that further comprises a modifier in a volume ratio of the active agent to the modifier wherein the modifier has an initial solubility in the hydrocarbon feed under the first operating condition that is different from the secondary active agent solubility.

17. The method of claim 16 wherein the active agent has a concentration ranging from about 99.9 wt. % to about 99 wt. %, about 99 wt. % to about 90 wt. %, about 90 wt. % to about 80 wt. %, about 80 wt. % to about 70 wt. %, about 70 wt. % to about 60 wt. %, or about 60 wt. % to about 50 wt. %.

18. The method of claim 17 wherein the modifier comprises water.

19. The method of claim 1 wherein the hydrocarbon material depleted in the acid comprises an acidic content equivalent to total acid number ranging from 0 to about 1.0 mg-KOH/g-hydrocarbon.

20. The method of claim 19 wherein the hydrocarbon material depleted in the acid is further depleted in chlorides.

21. The method of claim 1 wherein the separable enriched active agent phase under the second operating condition comprises an acidic content equivalent to total acid number ranging from about 1.0 to about 100.0 mg-KOH/g-active agent phase.

22. The method of claim 21 wherein the separable enriched active agent phase under the second operating condition further comprises a chloride content.

23. The method of claim 1 further comprising recovering the separable enriched active agent phase.

24. The method of claim 23 further comprising separating the separable enriched active agent phase from the acid to obtain a recovered active agent.

25. The method of claim 24 further comprising recycling the recovered active agent to the contacting step.

26. The method of claim 25 wherein recycling comprises modulating a composition of the recovered active agent to achieve the initial active agent solubility in the hydrocarbon material.

27. The method of claim 26 wherein modulating comprises adjusting a dielectric property of the recovered active agent.

28. The method of claim 1 further comprising modulating a composition of the active agent to achieve the initial active agent solubility in the hydrocarbon material.

29. The method of claim 28 wherein modulating comprises adjusting a dielectric property of the active agent.

30. The method of claim 1 wherein a composition of the active agent under the second operating condition is different from a composition of the active agent under the first operating condition.

31. The method of claim 1 wherein the active agent has a polarity between a polarity of the hydrocarbon feed and a polarity of water.

32. The method of claim 1 wherein a ratio of the active agent to the hydrocarbon feed ranges from about 1:10 to about 2:1.

33. The method of claim 1 further comprising contacting the hydrocarbon material depleted in the acid with a second active agent to further extract the acid from the hydrocarbon material depleted in the acid.

34. The method of claim 1 wherein the second operating condition is different from the first operating condition in a ratio of the active agent to the hydrocarbon feed.

35. The method of claim 1 wherein the acid solubility in the active agent ranges from about 0.01 wt. % to about 1 wt. %, about 1 wt. %, to about 5 wt. %, about 5 wt. % to about 10 wt. %, about 10 wt. % to about 20 wt. %, about 20 wt. % to about 30 wt. %, or about 30 wt. % to about 40 wt. %.

36. The method of claim 1 wherein the active agent is non-aqueous or is in the form of an aqueous mixture in which water is present at a concentration lower than a concentration of the active agent.

* * * * *